US009642466B2

(12) United States Patent
Milstead et al.

(10) Patent No.: US 9,642,466 B2
(45) Date of Patent: May 9, 2017

(54) UNIVERSAL MEDIA POCKET AND CHAIR WITH UNIVERSAL MEDIA POCKET

(71) Applicant: Wal-Mart Stores, Inc., Bentonville, AR (US)

(72) Inventors: Wendy Milstead, Bentonville, AR (US); Jason Ulichnie, Bentonville, AR (US)

(73) Assignee: WAL-MART STORES, INC., Bentonville, AR (US)

( * ) Notice: Subject to any disclaimer, the term of this patent is extended or adjusted under 35 U.S.C. 154(b) by 30 days.

(21) Appl. No.: 14/811,187

(22) Filed: Jul. 28, 2015

(65) Prior Publication Data

US 2016/0029804 A1 Feb. 4, 2016

Related U.S. Application Data

(60) Provisional application No. 62/031,513, filed on Jul. 31, 2014.

(51) Int. Cl.
*A47C 7/62* (2006.01)
*A47C 4/28* (2006.01)
(Continued)

(52) U.S. Cl.
CPC ..... *A47C 7/62* (2013.01)

(58) Field of Classification Search
CPC ..... A47C 7/62
USPC ..... 297/188.01, 188.18, 188.19, 188.2, 45; 224/275, 277, 278, 482, 483, 539, 544, 224/584, 585; 383/10, 11, 22, 97
See application file for complete search history.

(56) References Cited

U.S. PATENT DOCUMENTS 1,255,481 A 2/1918 Spranger
1,550,055 A * 8/1925 Augustine ..... A47C 1/04 297/188.18 X
(Continued)

FOREIGN PATENT DOCUMENTS

CN 201388661 1/2010
CN 201938633 8/2011
(Continued)

OTHER PUBLICATIONS

"OZtrail Big Boy Chair", Bivouac.co.nz, first accessed Apr. 18, 2014, most recently accessed Aug. 20, 2015; 1 page.
(Continued)

*Primary Examiner* — Rodney B White
(74) *Attorney, Agent, or Firm* — Schmeiser, Olsen & Watts LLP

(57) ABSTRACT

A universal media pocket is provided. Disclosed is a universal media pocket that includes a durable outer body, a pair of handles pivotably coupled to the durable outer body, and a closing mechanism at a base of the pair of handles and configured to close an inside volume enclosed by the durable outer body. The pair of handles in a first position are configured to attach the universal media pocket to an object and in a second position are configured to remove the universal media pocket from the object. Also disclosed is a chair with a universal media pocket. The chair arm includes a first and a second hook. The universal media pocket hangs from the chair arm, coupled to the chair arm using the first and the second hook.

11 Claims, 17 Drawing Sheets

(51) Int. Cl.

| | |
|---|---|
| ***B65D 33/08*** | (2006.01) |
| ***B65D 33/10*** | (2006.01) |
| ***B65D 33/14*** | (2006.01) |
| ***B65D 39/00*** | (2006.01) |

(56) References Cited

U.S. PATENT DOCUMENTS 1,571,475 A * 2/1926 Guenther ..... A45C 3/00 383/10 X
1,687,327 A * 10/1928 De Boer ..... A24F 19/0085 297/188.18 X
1,826,976 A * 10/1931 Wright ..... A45C 3/00 383/10 X
2,405,744 A * 8/1946 Sigmund ..... A45C 13/26 224/585 X
2,740,466 A * 4/1956 Du Priest ..... A47C 1/16 297/188.2 X
3,042,467 A * 7/1962 Germick ..... A47C 7/70 297/188.18 X
3,632,029 A * 1/1972 Sonner ..... B60N 3/08 224/275
4,339,061 A * 7/1982 Dunn ..... A61G 5/10 297/188.18 X
4,518,198 A * 5/1985 Daniels ..... A45C 9/00 297/229 X
4,773,708 A * 9/1988 Nastu ..... A47C 1/143 297/229 X
4,892,353 A * 1/1990 Goddard ..... A47C 31/11 297/188.2
5,092,682 A * 3/1992 Fenick ..... A47K 3/281 383/22 X
5,961,018 A * 10/1999 Abelbeck ..... B62B 3/146 224/584 X
5,971,242 A * 10/1999 Schuerman ..... B60R 11/0241 224/544 X
6,120,092 A * 9/2000 Asad ..... A47D 15/00 297/188.18
6,149,229 A * 11/2000 Dillon, Jr. ..... B60R 7/043 297/188.2
6,176,613 B1 * 1/2001 Chen ..... B65D 33/00 383/10 X
6,257,661 B1 * 7/2001 Eberle ..... A47C 7/70 297/188.2
6,397,398 B1 6/2002 Herder
6,626,337 B1 * 9/2003 Cox ..... B60N 3/08 224/275
6,629,722 B1 * 10/2003 Tang ..... A47C 7/62 297/188.2 X
7,284,791 B1 * 10/2007 Wright ..... A47C 31/008 297/188.18 X
7,641,279 B1 * 1/2010 Curcio ..... A47C 1/14 297/188.18
7,963,592 B1 * 6/2011 Stanley ..... A47C 1/143 297/188.04
8,032,951 B1 10/2011 Nestberg et al.
8,091,962 B2 * 1/2012 Quinn ..... A45B 11/00 297/45 X
8,251,443 B1 * 8/2012 Hahn ..... B60N 2/468 224/275
8,303,032 B1 * 11/2012 Platta ..... A47C 4/286 297/45 X
8,388,058 B2 3/2013 Krasley
8,408,791 B1 * 4/2013 Wang ..... B65D 33/02 383/10
8,465,090 B1 * 6/2013 O'Connor ..... A47C 7/62 297/188.18 X
8,701,951 B2 * 4/2014 Lucas ..... H01R 13/60 224/539 X
8,919,396 B2 * 12/2014 Nieves ..... A45C 3/06 383/22 X
9,039,077 B1 * 5/2015 Santamaria ..... A47C 7/72 297/45 X
2002/0074834 A1 * 6/2002 Summar ..... A47C 4/286 297/45 X
2002/0108981 A1 8/2002 Smith
2004/0155080 A1 * 8/2004 Fialla-Dori ..... B60R 7/043 224/275
2005/0098594 A1 * 5/2005 Truong ..... B60R 11/0264 224/275
2006/0082197 A1 * 4/2006 Luce ..... A47C 7/62 297/188.18
2006/0117453 A1 6/2006 Hood
2006/0228052 A1 * 10/2006 Hess ..... A45C 13/26 383/10
2008/0232720 A1 * 9/2008 Karagiannis ..... B65D 21/0205 383/22
2008/0312615 A1 12/2008 Hunter
2009/0285509 A1 * 11/2009 Giaquinto ..... A45C 3/00 383/22
2010/0313464 A1 12/2010 Bain et al.
2011/0081102 A1 * 4/2011 Wang ..... B65D 33/08 383/10
2012/0174852 A1 7/2012 Greenstone
2013/0234478 A1 * 9/2013 Peck ..... A47C 7/62 297/188.2
2013/0328362 A1 12/2013 Miller
2014/0132046 A1 * 5/2014 Driscoll ..... B60N 2/4666 297/188.18
2015/0208810 A1 * 7/2015 Kim ..... A47C 7/72 297/188.18

FOREIGN PATENT DOCUMENTS

| | | |
|---|---|---|
| CN | 201967984 | 9/2011 |
| CN | 202211302 | 5/2012 |
| CN | 102642679 | 8/2012 |
| CN | 202890886 | 4/2013 |
| CN | 202999655 | 6/2013 |
| WO | 2009025638 | 2/2009 |
| WO | 2013057683 | 4/2013 |

OTHER PUBLICATIONS

"XDR Assault Water Resistant Jacket", Scorpion EXO, Scropionusa.com, first accessed Apr. 18, 2014, most recently accessed Aug. 20, 2015; 1 page.

"Stash Waterproof Pocket Shorts", BlessThisStuff.com, first accessed Apr. 18, 2014, most recently accessed Aug. 20, 2015; 8 pages.

"Clam Ups!", Clam-Ups.com, first accessed Apr. 18, 2014, most recently accessed Aug. 20, 2015; 2 pages.

"Lowepro expands 'Passport Series' line of camera bags", DPreview.com, Mar. 6, 2014, accessed Aug. 20, 2015, 6 pages.

"Hoofer", Ping.com, first accessed Apr. 18, 2014, most recently accessed Aug. 20, 2015; 2 pages.

* cited by examiner

UNIVERSAL MEDIA POCKET AND CHAIR WITH UNIVERSAL MEDIA POCKET

CROSS REFERENCE TO RELATED APPLICATION

This application claims priority to U.S. Patent Application Ser. No. 62/031,513, filed Jul. 31, 2014, and entitled "Universal Media Pocket", which is incorporated herein by reference in its entirety.

FIELD

The present invention relates generally to media pockets. More particularly, the present invention relates to a universal media pocket.

BACKGROUND

Conventional pockets have been around for ages. However, conventional pockets, e.g., media pockets, are fixed with respect to an article that carries them. For example, conventional media pockets are a part of an equipment and cannot be removed to be used with another equipment. Further, durability and protection offered by such media pockets is limited, for example, when used in outdoor environments for various outdoor activities such as kayaking, mountain climbing, camping, etc. It is desirable to have a universal media pocket that can be used to keep electronic equipment safe and secure while in an outdoor environment and is portable to be used with different equipment.

SUMMARY

Accordingly, it is desirable to provide a universal media pocket for use with different equipment. The foregoing needs are met, to a great extent, by the disclosed invention, wherein in one aspect, a universal media pocket is provided. The universal media pocket includes a durable outer body, a pair of handles pivotably coupled to the durable outer body, and a closing mechanism at a base of the pair of handles and configured to close an inside volume enclosed by the durable outer body. The pair of handles in a first position are configured to attach the universal media pocket to an object and in a second position are configured to remove the universal media pocket from the object. In some embodiments, the pair of handles includes a pair of holes, respectively, configured to move the pair of handles between the first position and the second position. In another aspect, disclosed in a chair that includes a chair arm. The chair arm has a first and a second hook. A universal media pocket is coupled to each of the first and the second hook. In some embodiments, the universal media pocket includes an outer body pouch with a compartment for encasing an electronic device, a closing mechanism for the compartment, and a first and a second ring coupled to the outer body pouch. The first ring couples to the first hook, and the second ring couples to the second hook. The universal media pocket hangs from the chair arm, from the first and the second hook.

There has thus been outlined, rather broadly, embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. While this disclosure has a universal media pocket, one of ordinary skill the art after reviewing this disclosure will understand that various principles of this disclosure may be applied to a variety of media pockets. For example, hard cased, mixed hard and soft cased, internally hard but with soft outside cover, VELCRO® meshed case, or other types of mixed construction media pockets may be used in accordance with the disclosure herein. The principles described herein are not limited to universal media pockets only that they are primarily discussed herein as an example.

The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
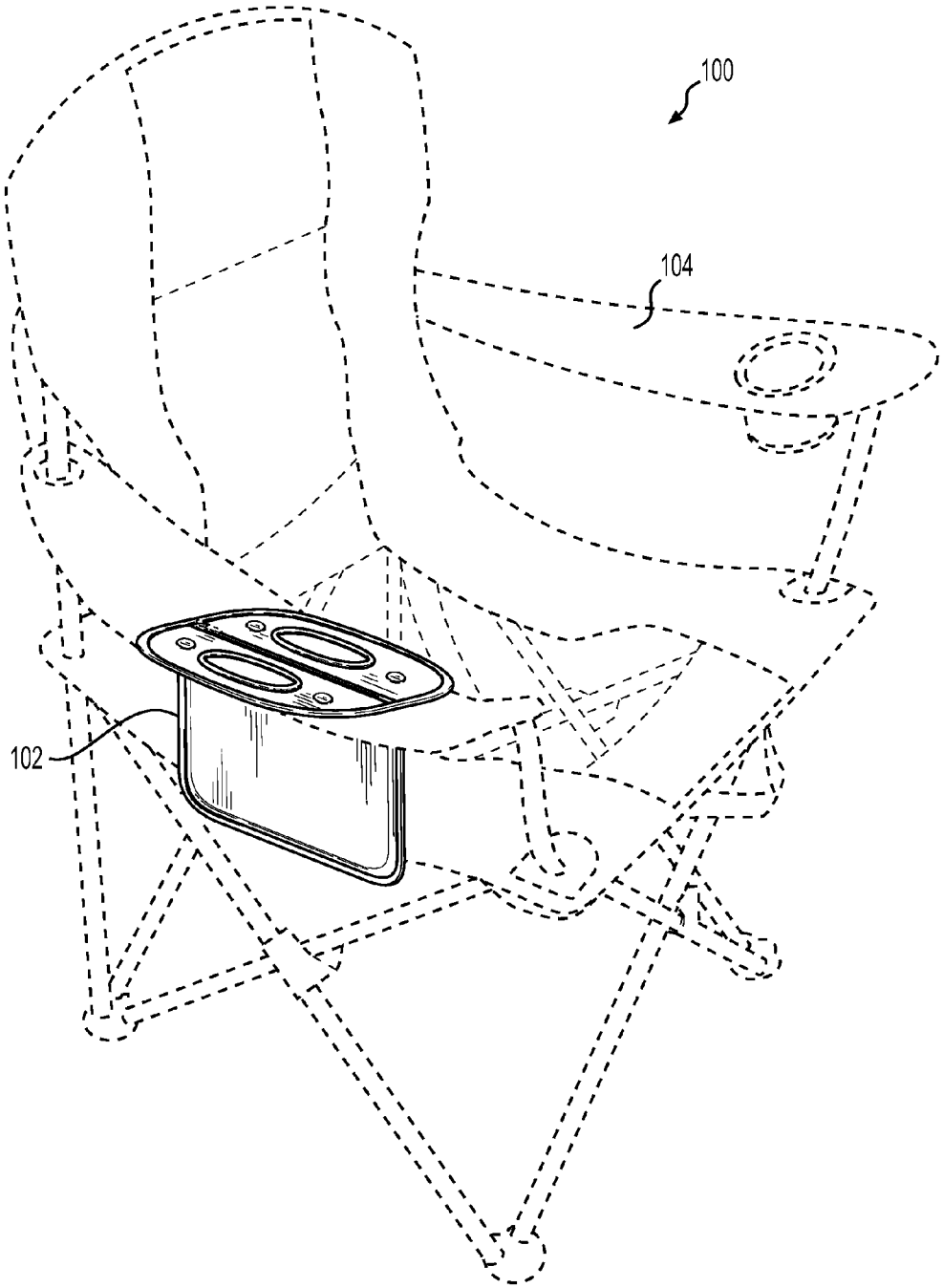
FIG. 1 illustrates an exemplary environment showing a universal media pocket, in accordance with an aspect of this disclosure.

Referring to FIG. 1, an exemplary environment showing a universal media pocket 102 in an environment 100 is illustrated, in accordance with an aspect of this disclosure. FIG. 1 through FIG. 14 show various aspects of universal media pocket 102. Also disclosed in this document is a universal media pocket 302, shown in FIG. 15 through FIG. 22. Universal media pockets 102 and 302 may be attached to an object 104, e.g., a chair. The environment 100 may be an outdoor environment, an indoor environment, or a combination of both. The universal media pockets 102 and 302 may also be referred to as a protective pocket. In one aspect, universal media pockets 102 and 302 may be attached to, be sewn into, or added to tents, chairs, kayaks, boats, sleeping bags, coolers, etc. Universal media pockets 102 and 302 may be in the form of a bag, for example, that may be zippered and waterproofed (dry bag). Universal media pockets 102 and 302 could be a hard-sided dry box that would clip/fasten to existing items (tents, chairs, gazebos, etc.). In one aspect, there are two example ways of implementing universal media pockets 102 and 302—one is sewn-in to all the textile products like tents, sleeping bags, chairs, etc., and the other is a modularized system where the consumers may buy universal media pockets 102 or 302 (in different sizes) and attach to the product to be used, e.g., the object 104, such that there is flexibility in meeting different needs. Universal media pockets 102 and 302 may be tricot-lined, waterproof, or impact-resistant with a hard shell. Other areas where universal media pockets 102 and 302 may be used are built-in storage for coolers, kayaks, fishing tackle boxes—so universal media pockets 102 and 302 are not limited to only textile solutions and have the potential to span across all consumer items and more. In one aspect, the present disclosure specifically addresses the need for pockets to protect mobile technology that people take with them on outdoor activities. Universal media pockets 102 and 302 may be integrated into outdoor equipment, specifically sized for use with mobile electronics, and may be a modular add-on system that allows for use with a wide range of legacy products already existing in markets.

Universal media pockets 102 and 302 are different from pockets in garments. In one aspect, universal media pockets 102 and 302 are configured to store, display, or show, electronic and multimedia devices with connectivity (e.g., smartphone enabled) and/or protection capabilities (e.g., waterproof, impact resistance). Universal media pockets 102 and 302 may serve as both a pocket for storage and a holder for viewing. For example, one or more surfaces of universal media pockets 102 and 302 may be transparent for the user to see content on the electronic device stored inside universal media pockets 102 or 302. Universal media pocket 102 and 302 may be used with products used in a wide variety of activities: camping, fishing, hunting, watersports, sports games, cook outs, picnics, etc. Examples of such products include, but are not limited to, tents, canopies, cots, chairs, tables, sleeping bags, backpacks, coolers, deer stands, canoes, etc.

While this disclosure primarily discusses universal media pockets 102 and 302, one of ordinary skill the art after reviewing this disclosure will understand that various principles of this disclosure may be applied to a variety of media pockets. For example, hard outer case, hard inner case, or any other protective media pockets removable and attachable to different devices and/or objects may be used in accordance with the disclosure herein. The principles described herein are not limited to universal media pockets only that they are primarily discussed herein as an example.

The term "universal" may relate to universal media pockets 102 and 302 being configured to be used for a variety of devices/electronic devices that can be stored in universal media pockets 102 and 302, as well as for the universal nature of attachment to various objects (e.g., outdoor objects such as lawn chairs, kayaks, tents, coolers, sleeping bags, etc.). The tem "media" may generally relate to any item being stored inside universal media pockets 102 or 302, and more particularly, may refer to tangible non-transitory computer readable media, or electronic media, and electronic devices.

In FIG. 1, universal media pocket 102 is shown attached to object 104 in the example form of a chair (shown in chained lines), although any object may be used such that a user of the universal media pocket 102 is free to use his or her hands for other purposes, and does not have to worry about where his/her electronic or other devices will be stored. As shown in FIG. 1, universal media pocket 102 fits into, and rests on, a cutout portion of the object 104. The object 104 to which universal media pocket 102 is attached may itself have an attachment mechanism that may aid or be complementary to an attachment device 208 (discussed with respect to FIG. 2) of universal media pocket 102.

Figure 2:
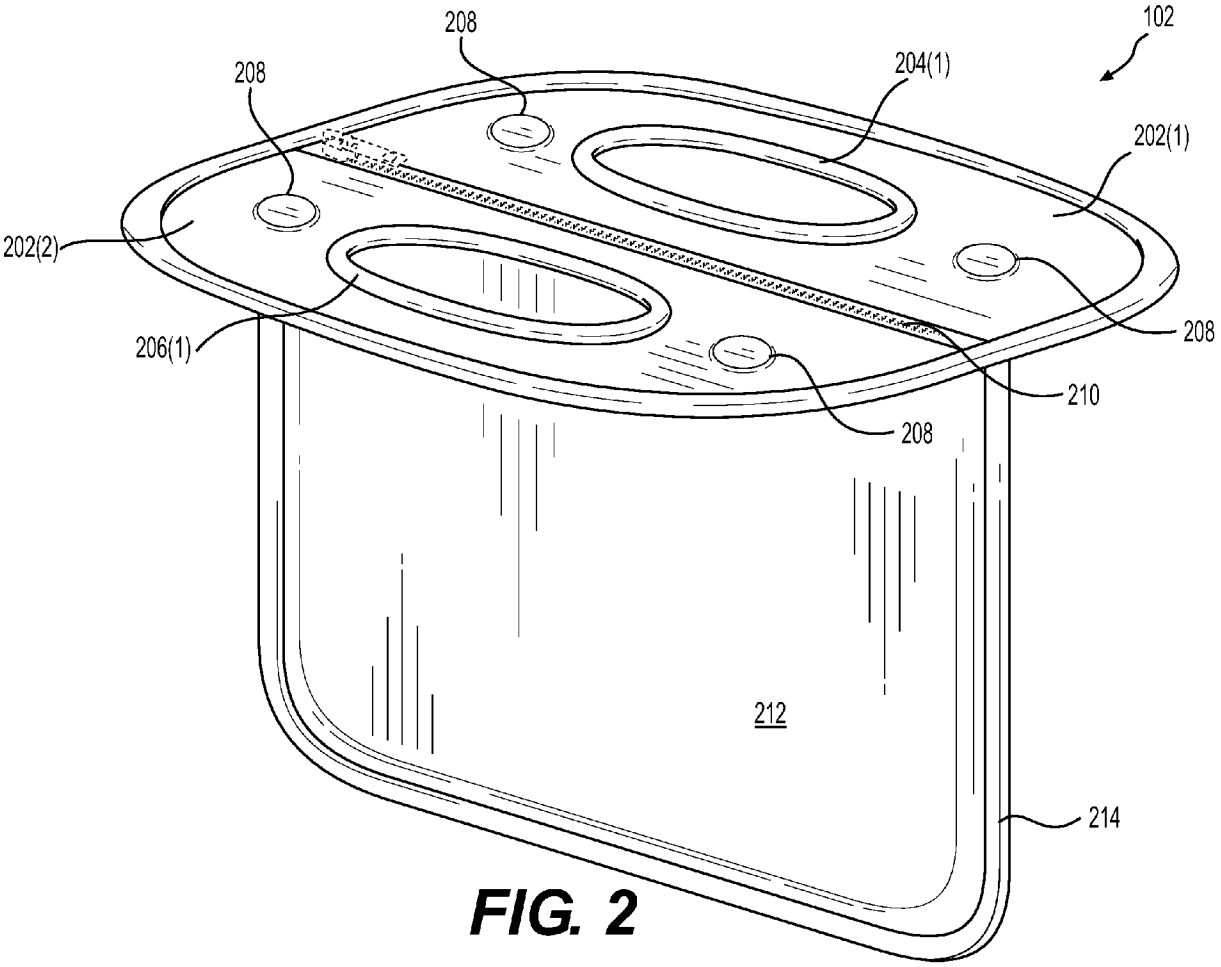
FIG. 2 illustrates a perspective view of the universal media pocket of FIG. 1, in accordance with an aspect of this disclosure.

Referring to FIG. 2, universal media pocket 102 has a pair of handles 202(1) and 202(2). The pair of handles 202(1) and 202(2) are shown in FIGS. 1 and 2, for example, in a first position, flattened out and resting on an arm of the object 104, although the universal media pocket 102 may attach to any other part of the object 104.

Referring to FIG. 2, a perspective view of the universal media pocket 102 is presented. The universal media pocket 102 includes a pair of holes 204(1), 204(2) (shown as cutouts) in the pair of handles 202(1) and 202(2). A user may insert his or her fingers in the pair of holes 204(1), 204(2) to carry the universal media pocket 102 after removing universal media pocket 102 from chair 104 or other object. In one aspect, the pair of handles 202(1), 202(2) may each include attachment devices 208 (e.g., one or more pairs of magnets), shown as four circles on the pair of handles 202(1) and 202(2), although shapes other than circles could be used. For example, the first handle 202(1) includes a first pair of attachment devices 208 and the second handle 202(2) includes a second pair of attachment devices 208. The attachment devices 208 may include VELCRO®, hooks, carabineers, and/or magnets.

Figure 7:
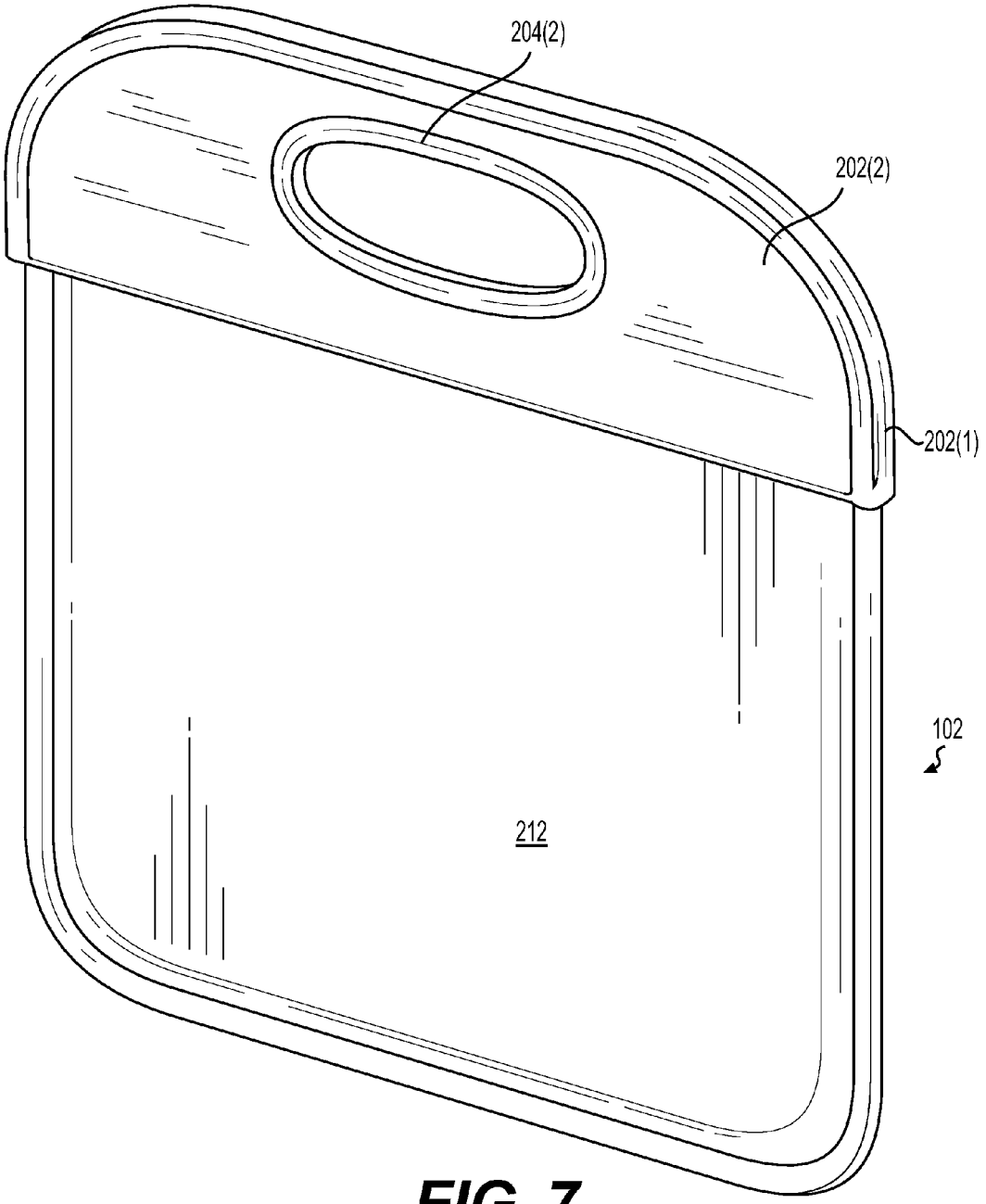
FIG. 7 illustrates a perspective view of the universal media pocket of FIG. 1 with the pair of handles in a second position, in accordance with an aspect of the disclosure.

The first pair of attachment devices 208 and the second pair of attachment devices 208 may be of opposite polarities such that when the pair of handles 202(1) and 202(2), respectively, are brought together to a second position (e.g., as illustrated in FIG. 7), the first and the second pairs of attachment devices 208 attract each other and the pair of handles 202(1) and 202(2) stick together, until a force greater than an attraction force (e.g., a magnetic attraction force) between the pair of handles 202(1) and 202(2) is applied to separate them. The first position of the pair of handles 202(1) and 202(2) may be substantially perpendicular to the second position, for example, although other relative angular orientations may exist. The attachment devices 208 may be attached inside the pair of handles 202(1) and 202(2), or may be on outside surfaces of the pair of handles 202(1) and 202(2). Each of the pair of handles 202(1) and 202(2) includes one or more of the attachment devices 208 (e.g., magnets) such that in the first position, the attachment devices 208 on the first handle 202(1) couples to an attachment device (e.g., magnet) of opposite polarity on the object 104 (e.g., the chair in FIG. 1).

In the second position, e.g., as illustrated in FIG. 7, each attachment device 208 in each of the pair of handles 202(1) and 202(2) is of opposite polarity, with respect to the other to keep the pair of handles 202(1) and 202(2) in the second position until a force greater than an attachment force between the attachment devices 208 on different ones of the pair of handles 202(1) and 202(2) is applied. Alternatively, instead of a circular shape of the attachment devices 208 shown in FIG. 2, one or more rectangular or polygonal shaped attachment devices 208 on the pair of handles 202(1) and 202(2) may be used. By way of example only, instead of magnets, other types of attachment devices 208 including but not limited to VELCRO® meshes or buttons or latching mechanisms may be used to attach the two handles 202(1) and 202(2) of the universal media pocket 102.

The pair of handles 202(1) and 202(2) may pivot about a durable outer body 212 of the universal media pocket 102 between the first and the second positions, as well as to other positions at or near a closing mechanism 210. In one example, the closing mechanism 210 is a zipper, although other types of closing mechanisms (e.g., magnetic or spring based mechanisms) could be used. The pair of handles 202(1), 202(2) may be made of the same material or of different material as that of the durable outer body 212 of the universal media pocket 102. In the embodiment of universal media pocket 102 shown in FIG. 1 through FIG. 14, pair of handles 202(1) and 202(2) in the first position, as shown in FIG. 1 through FIG. 5, are perpendicular to durable outer body 212. Pair of handles 202(1) and 202(2) in the second position, as shown in FIG. 7 through FIG. 11, are parallel to durable outer body 212.

The closing mechanism 210 may be arranged to isolate an inner volume 1202 (shown in FIG. 12) of the durable outer body 212 of the universal media pocket 102. The durable outer body 212 may be tricot-lined polymeric material, although other types of suitable materials that are strong but flexible materials, such as resin or polymer based materials may be used.

Figure 3:
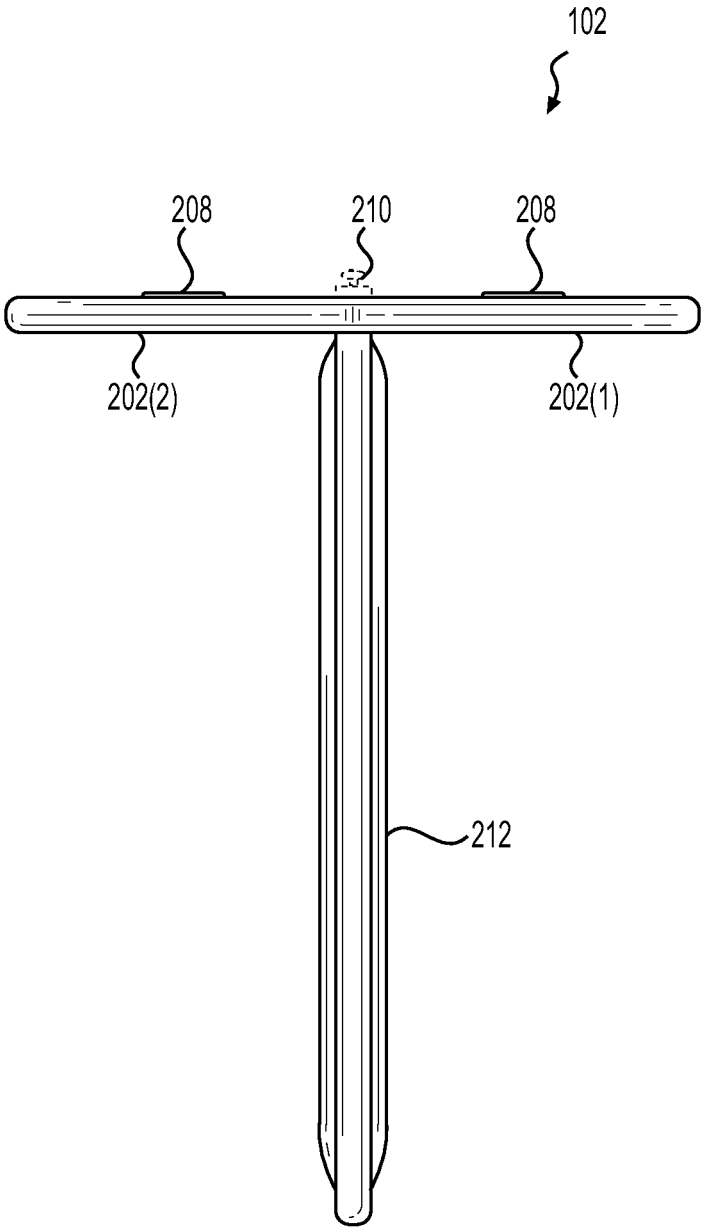
FIGS. 3 and 4 show a right side and a left side elevation view, respectively, of the universal media pocket of FIG. 1, in accordance with an aspect of this disclosure.
Figure 4:
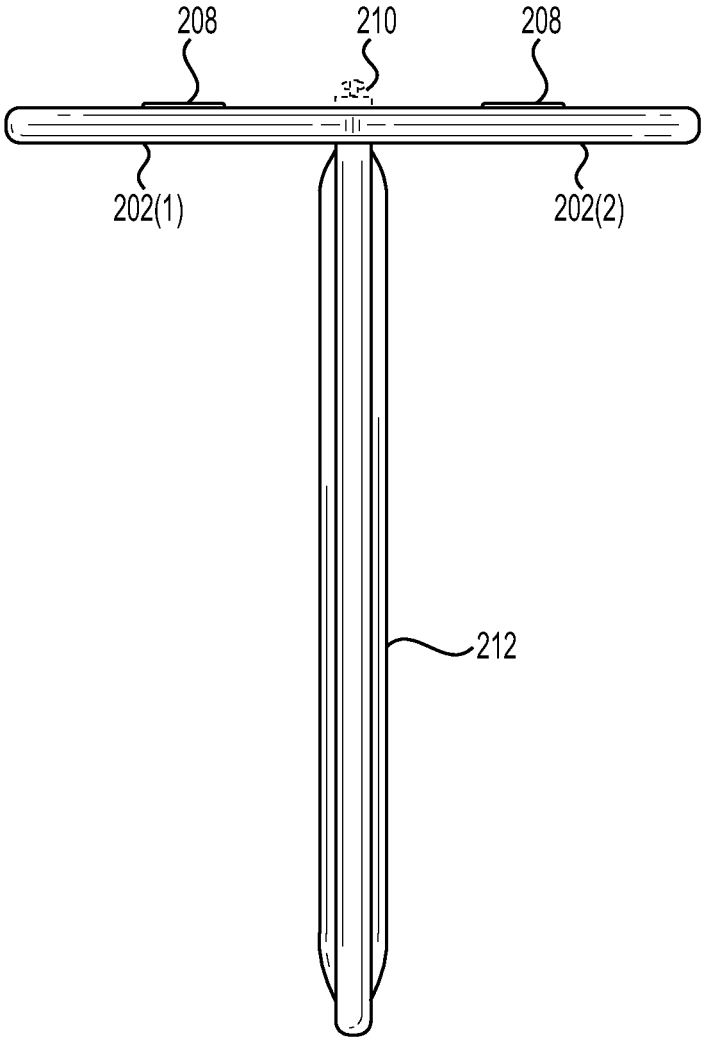
Figure 5:
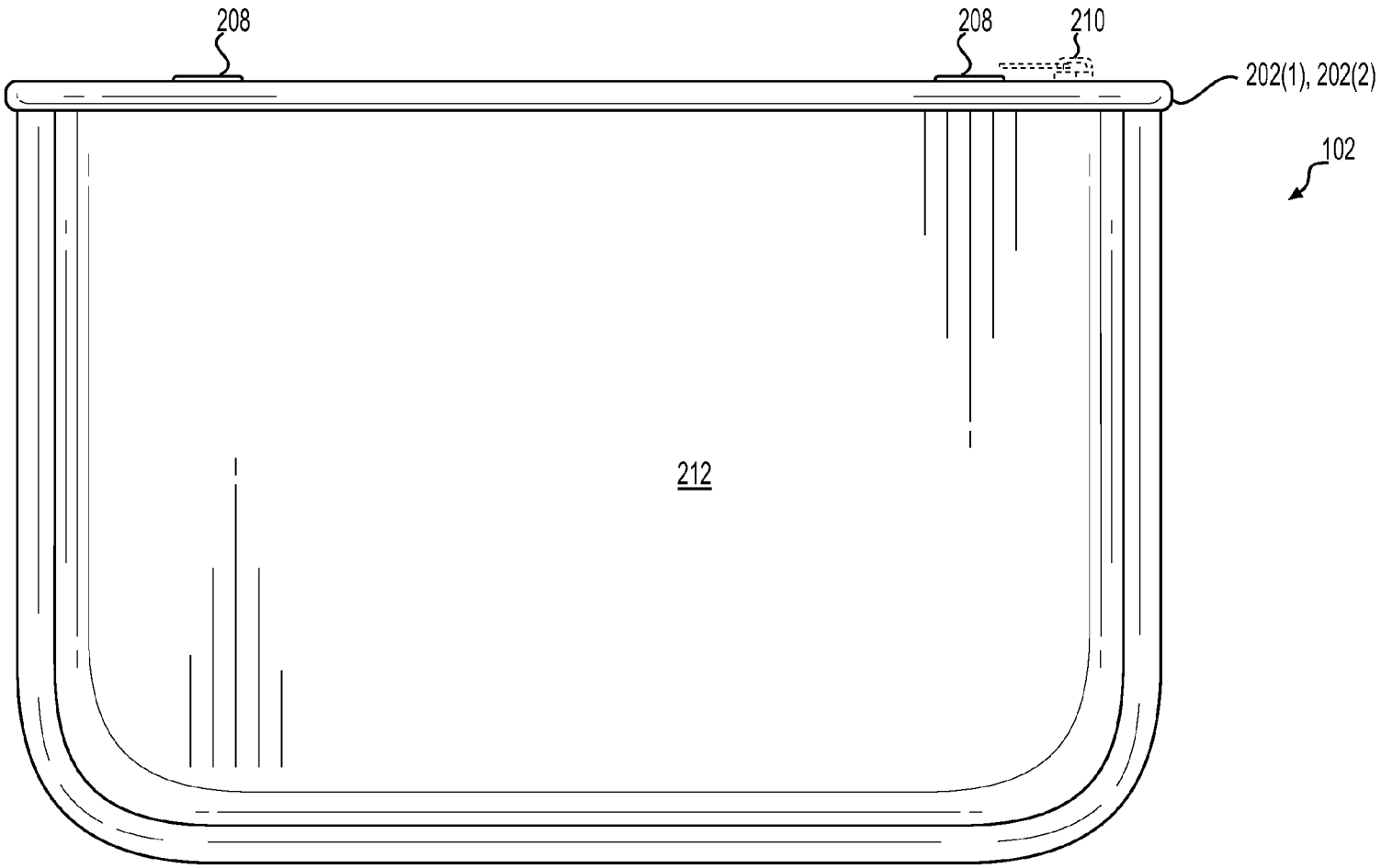
FIG. 5 illustrates a front side elevation view of the universal media pocket showing a durable outer body, in accordance with an aspect of this disclosure.
Figure 6:
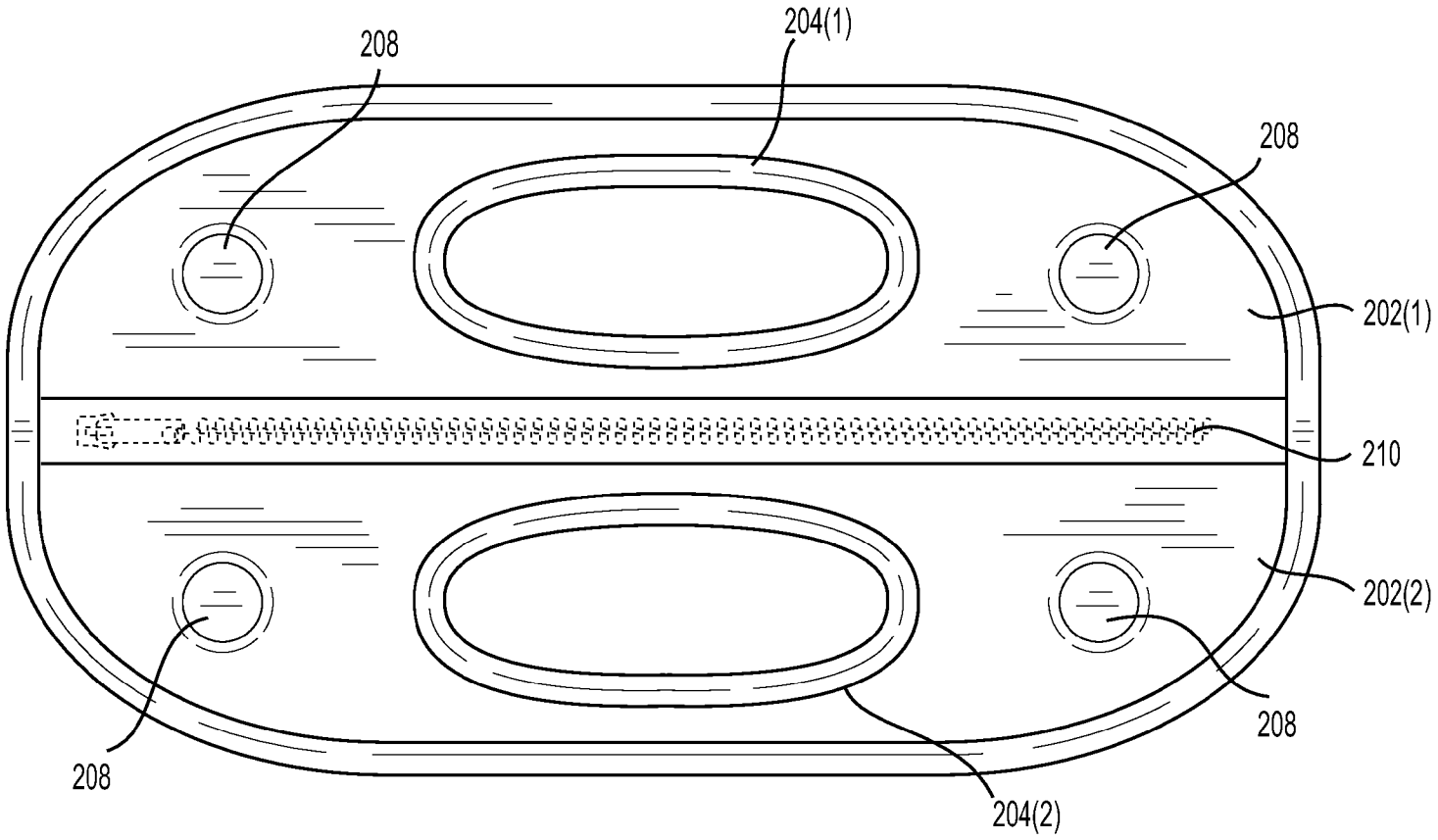
FIG. 6 illustrates a top view or a plan view of the universal media pocket, with the closing mechanism in a closed or shut position, in accordance with an aspect of this disclosure.

FIGS. 3 and 4 show a right side and a left side elevation view, respectively, of the universal media pocket 102. FIG. 5 illustrates a front side elevation view of the universal media pocket 102 showing the durable outer body 212. FIG. 6 illustrates a top view or a plan view of the universal media pocket 102, with the closing mechanism 210 in a closed or shut position.

FIG. 7 illustrates a perspective view of universal media pocket 102 with the pair of handles 202(1), 202(2) in the second position, in accordance with an aspect of the disclosure. The second position may be effectuated when the universal media pocket 102 is to be removed from the object 104, is being attached to the object 104, or is being carried around or transported, for example, from a chair to a tent to a kayak, etc.

Figure 8:
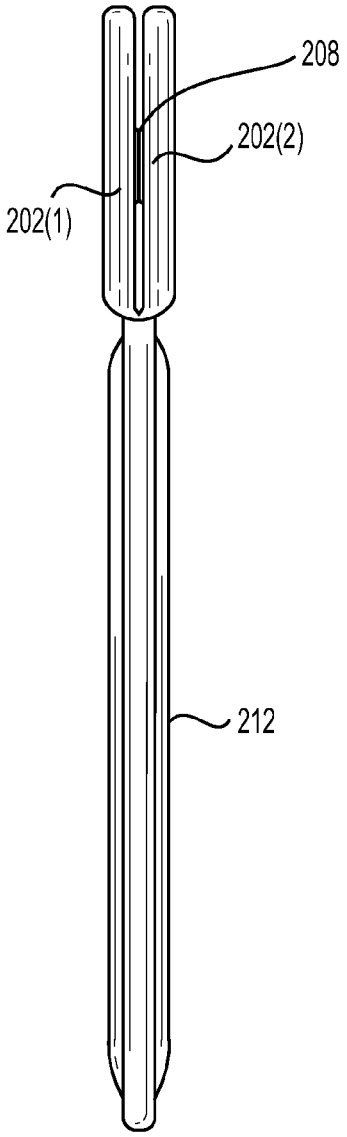
FIGS. 8 and 9 show right side and left side elevation views, respectively, of the universal media pocket of FIG. 1 with the pair of handles in the second position, in accordance with an aspect of this disclosure.
Figure 9:
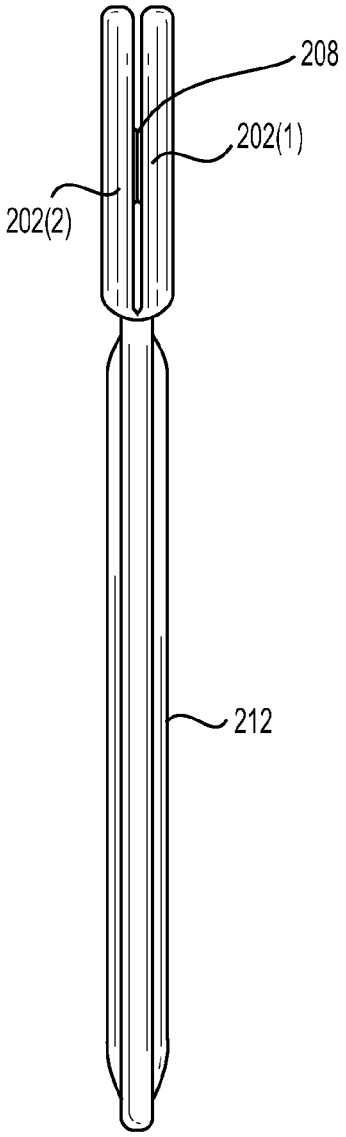
Figure 10:
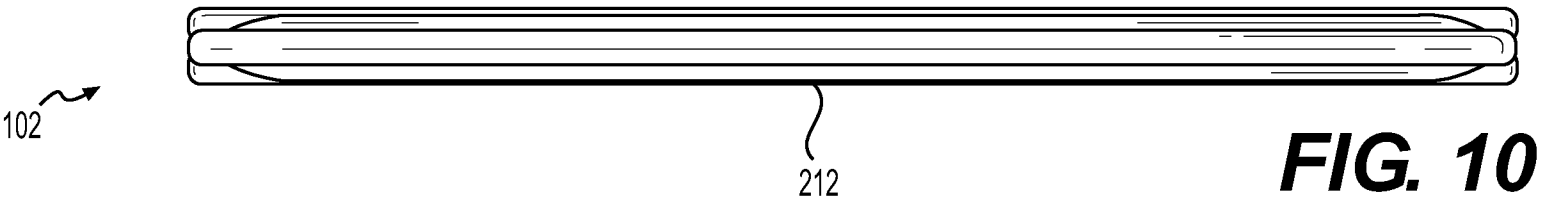
FIGS. 10 and 11 illustrate bottom and top views, respectively, of the universal media pocket of FIG. 1 with the pair of handles in the second position, in accordance with an aspect of this disclosure.
Figure 11:
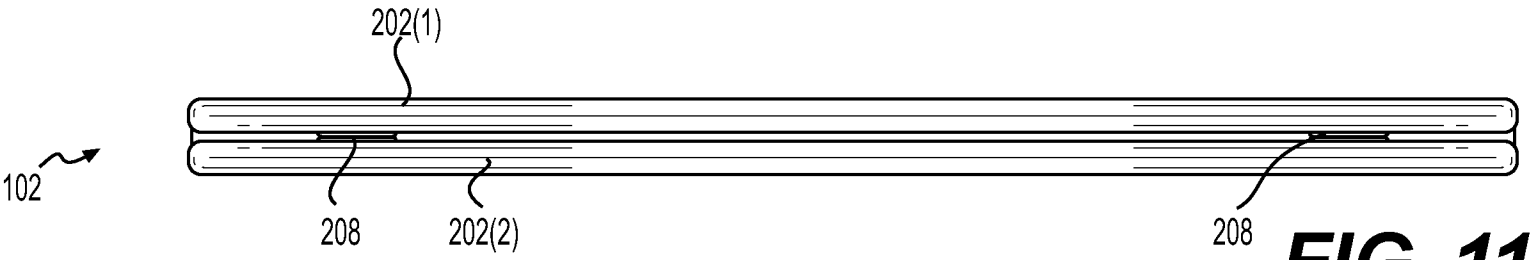

FIGS. 8 and 9 show right side and left side elevation views, respectively, of the universal media pocket 102 with the pair of handles 202(1) and 202(2) in the second position. FIGS. 10 and 11 illustrate bottom and top views, respectively, of the universal media pocket 102 with the pair of handles 202(1) and 202(2) in the second position.

Figure 12:
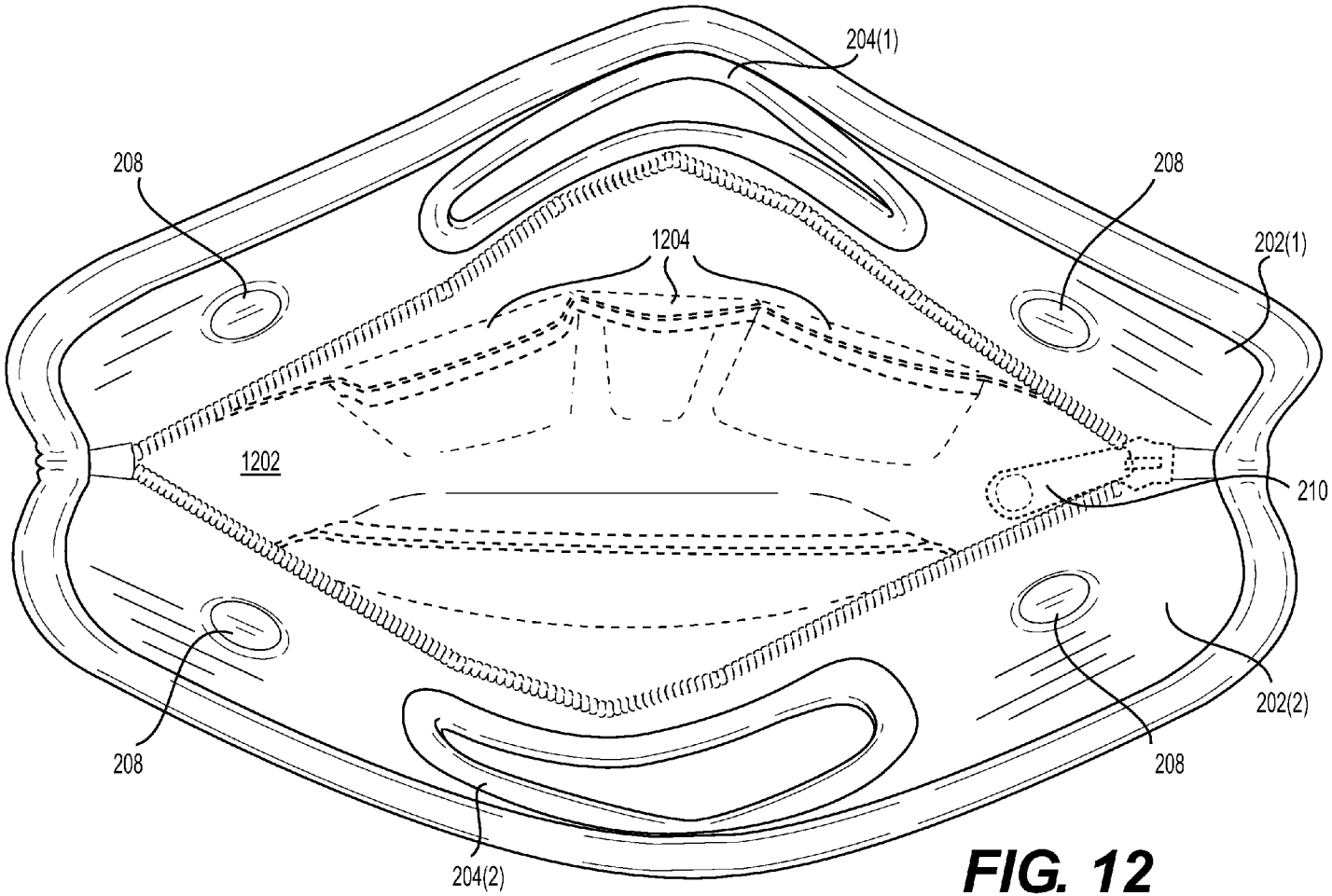
FIG. 12 illustrates the universal media pocket of FIG. 1 in an open position with the inside volume shown, in accordance with an aspect of the disclosure.

FIG. 12 illustrates the universal media pocket 102 in an open position with the inside volume 1202 shown, in accordance with an aspect of the disclosure. The inside volume 1202 may be isolated from the external environment 100 by the closing mechanism 210, e.g., a zipper. The inside volume 1202 may include one or more compartments or pockets 1204 to store one or more devices (e.g., electronic devices) securely and safely. In one aspect, the universal media pocket 102 may include a locking device (not shown) to prevent access to the inside volume 1202 and hence to the devices stored in the inside volume 1202.

Figure 13:
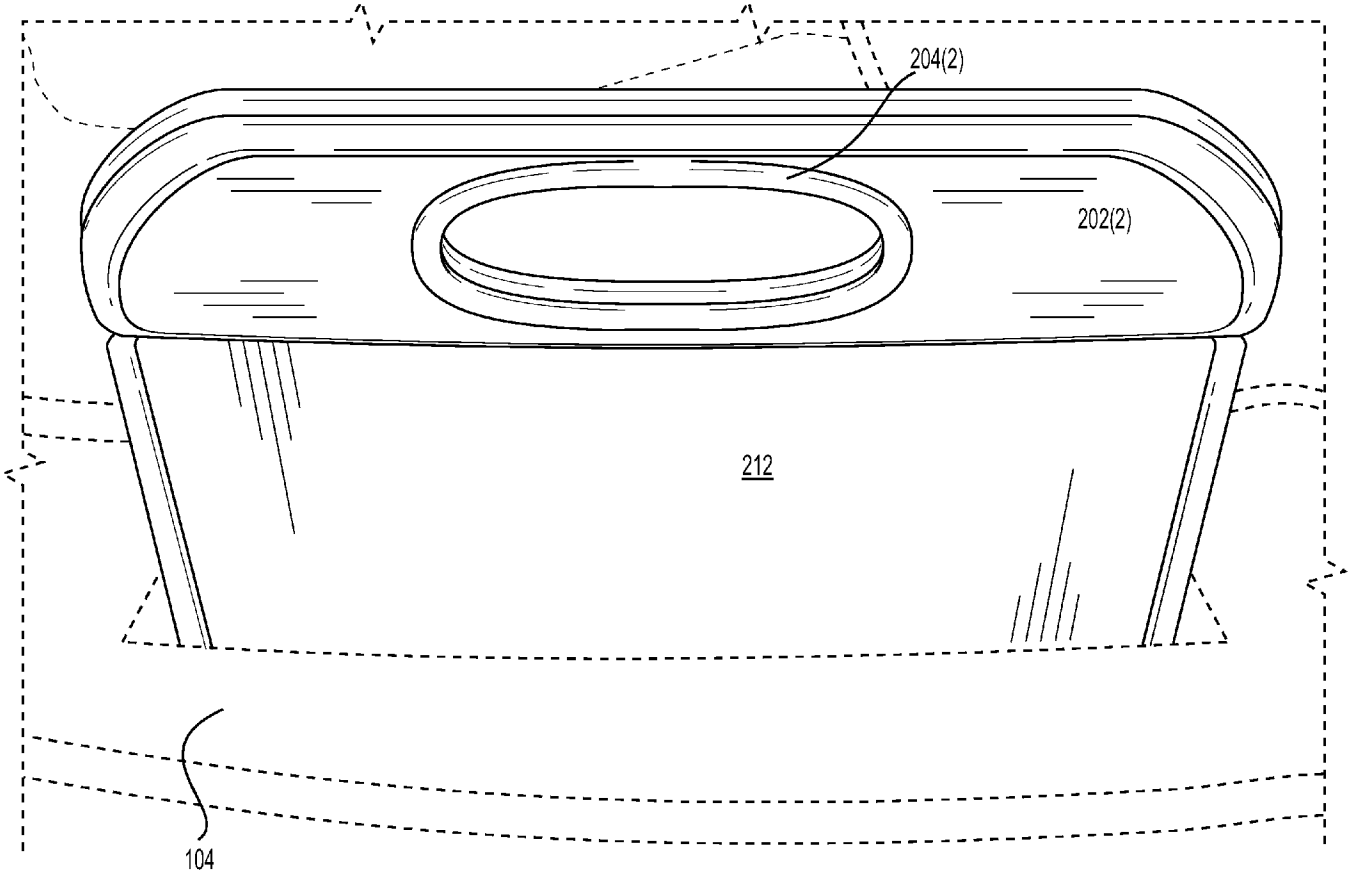
FIGS. 13 and 14 illustrate the universal media pocket of FIG. 1 being inserted into the object in an example use, in accordance with an aspect of this disclosure.
Figure 14:
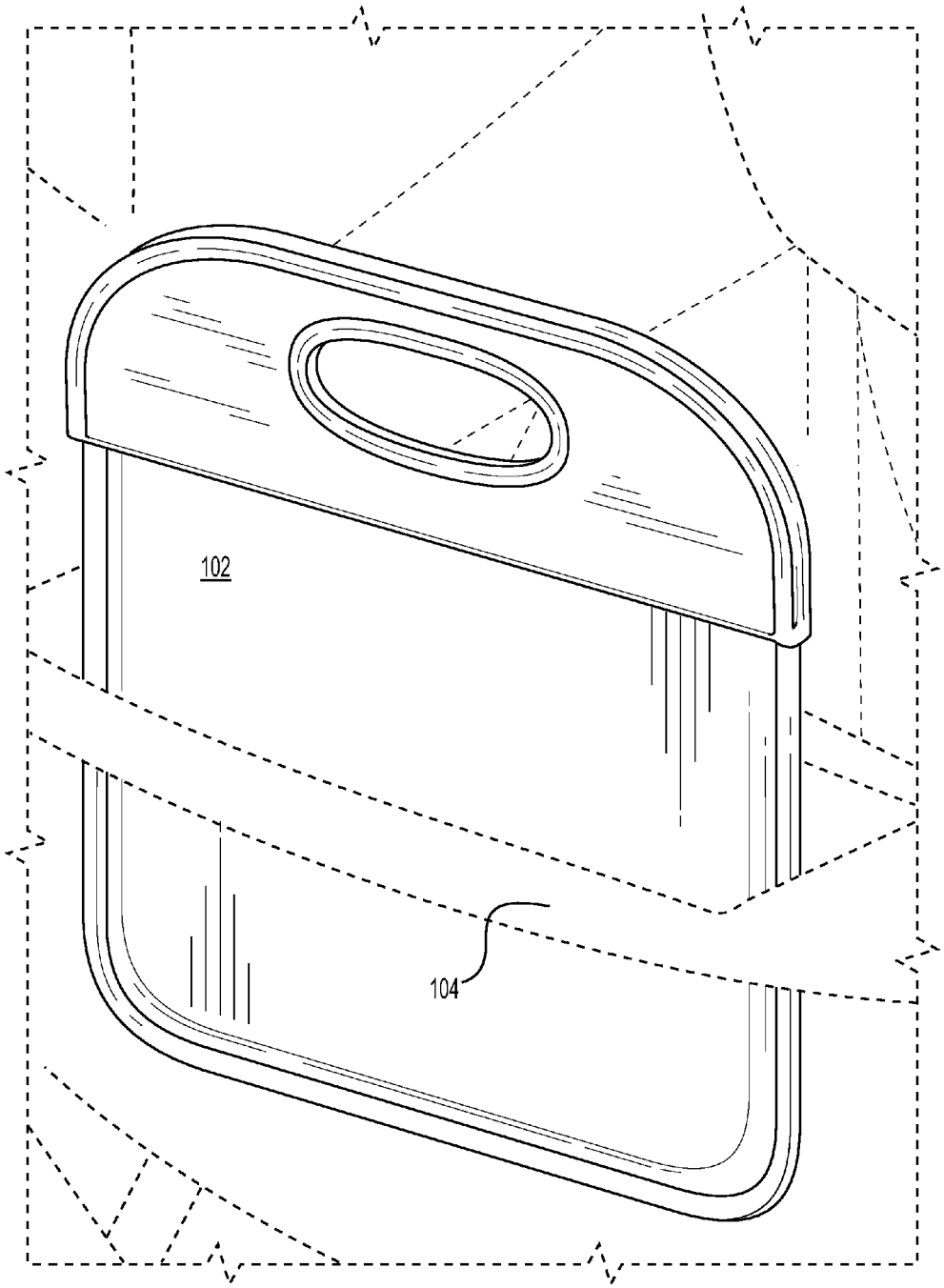

FIGS. 13 and 14 illustrate the universal media pocket 102 being inserted into the object 104 (a lawn chair in this example) in an example use. The pair of handles 202(1), 202(2) are illustrated in the second position and a user may insert or remove the universal media pocket 102 into the object 104. The object 104 may have a slot or a recess to accommodate or hold the universal media pocket 102. Upon insertion, the pair of handles 202(1), 202(2) may pivot from the second position to the first position (shown in FIG. 1). The universal media pocket 102 may then reside on the object 104, freeing the user from carrying the universal media pocket 102 around. In an alternative aspect, the universal media pocket 102 may have recesses for hooks on the object 104 from which the universal media pocket 102 may hang from or attach to. Likewise, in yet another alternative aspect, the universal media pocket 102 may include hooks on the durable outer body 212 that may attach to recesses in the object 104. In still another alternative aspect, the universal media pocket 102 may include both hooks and recesses to attach to different objects, depending on a configuration of the various objects to which the universal media pocket 102 attaches.

Figure 15:
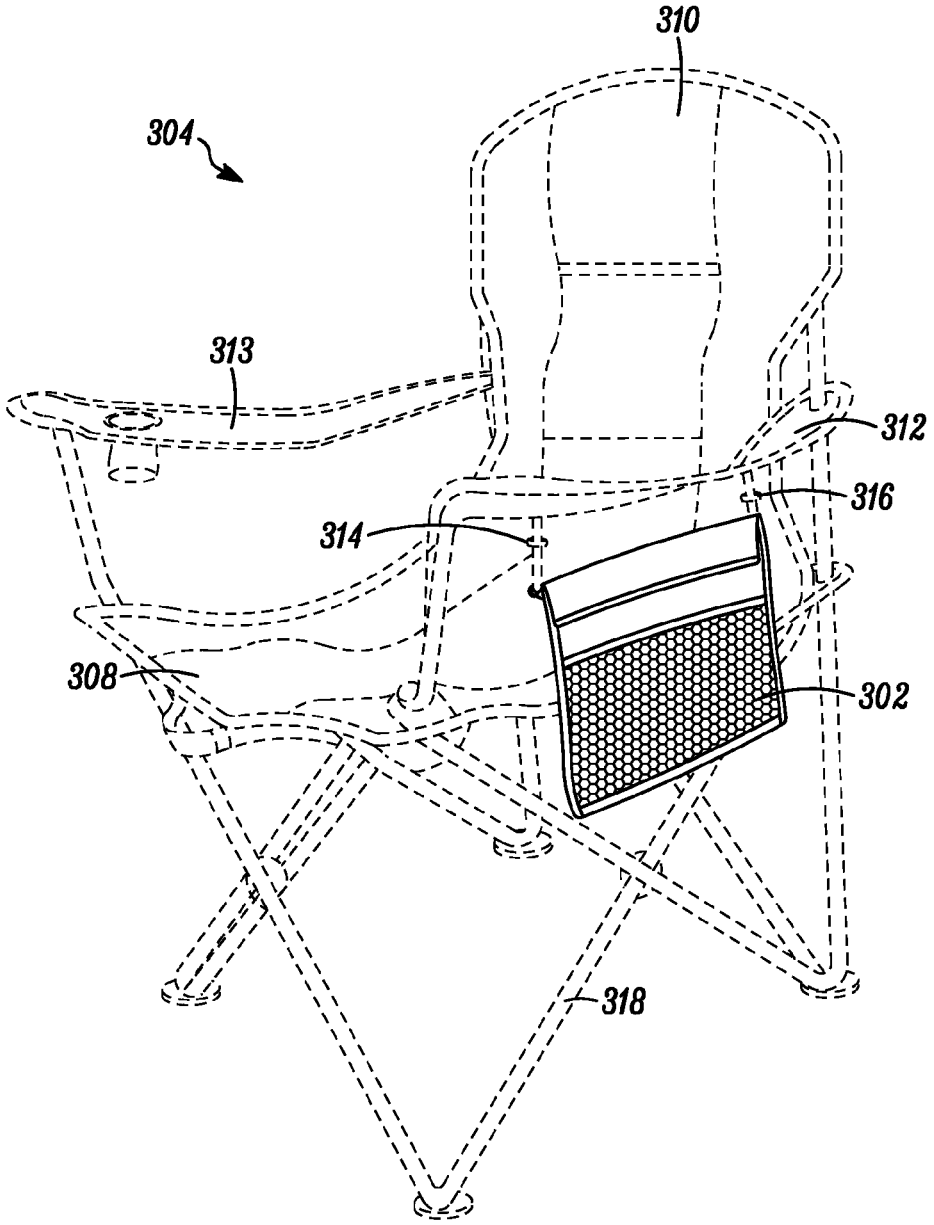
FIG. 15 shows a perspective view of an embodiment of a chair and a universal media pocket.
Figure 16:
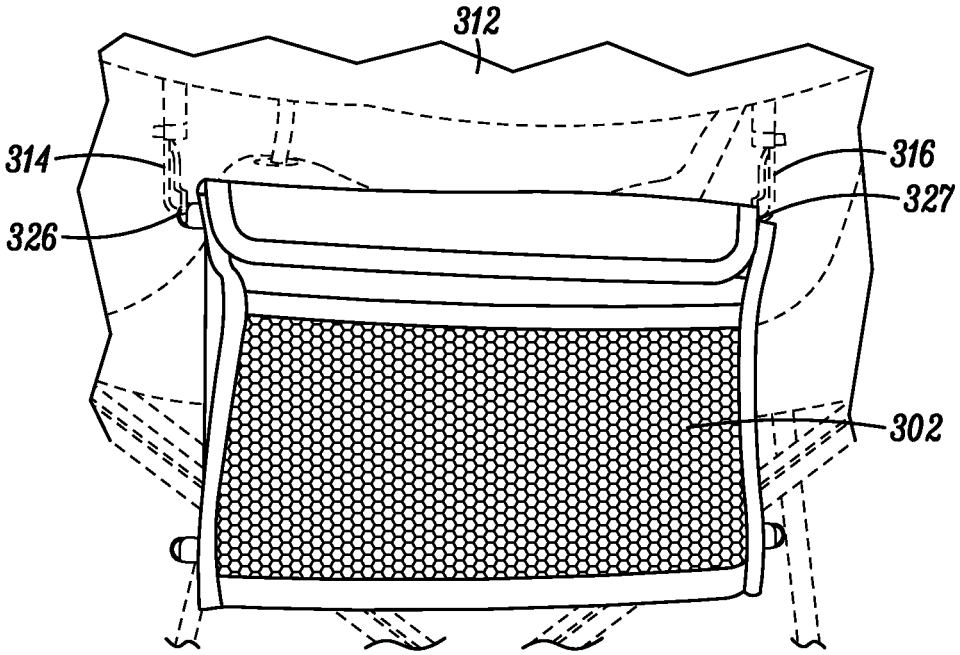
FIG. 16 shows a side view close up of the universal media pocket of FIG. 15 hanging from the arm of the chair of FIG. 15.

FIGS. 15 and 16 illustrate an embodiment of a chair 304 and a universal media pocket 302. Universal media pocket 302 in this embodiment hangs from an arm 312 of chair 304. FIG. 15 shows a perspective view of chair 304 and universal media pocket 302. FIG. 16 shows a close-up front view of universal media pocket 302 hanging from a first hook 314 and a second hook 316 of arm 312. Chair 304 includes a chair structure that includes a chair back 310, a chair seat 308, chair legs 318, and two chair arms 312 and 313. Chair arm 312 in this embodiment includes first hook 314 and second hook 316. First hook 314 and second hook 316 are each coupled to chair arm 312. First hooks 314 and second hook 316 hang from the underside of chair arm 312. Universal media pocket 302 removeably couples to first and second hooks 314 and 316 so that universal media pocket 302 can conveniently hold electronic devices and other items while a user is in or near chair 304.

Figure 17:
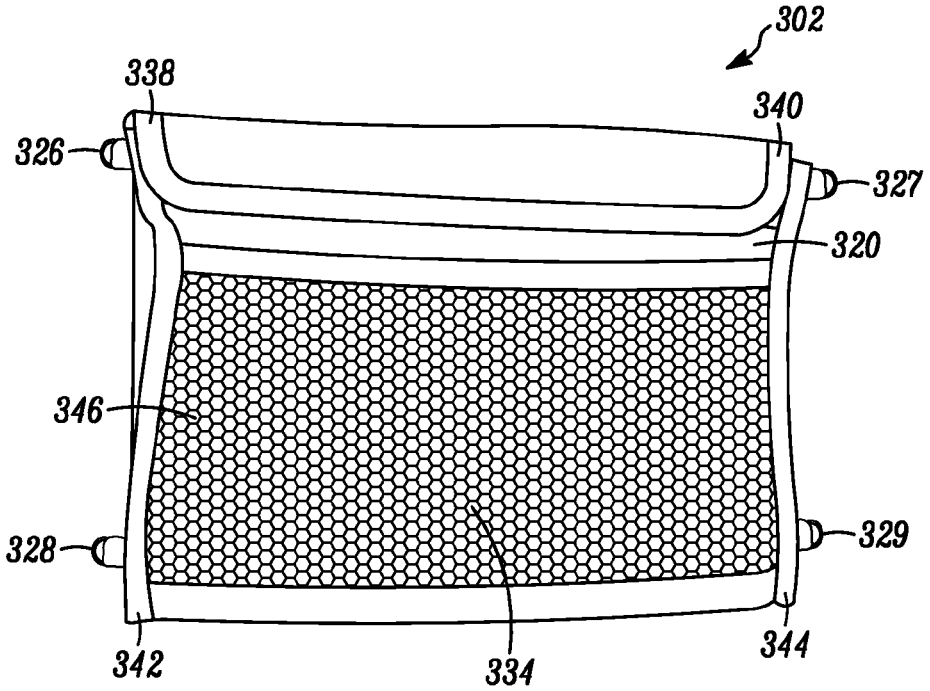
FIG. 17 shows a front view of the universal media pocket of FIG. 15 with the closing mechanism in the closed position.
Figure 18:
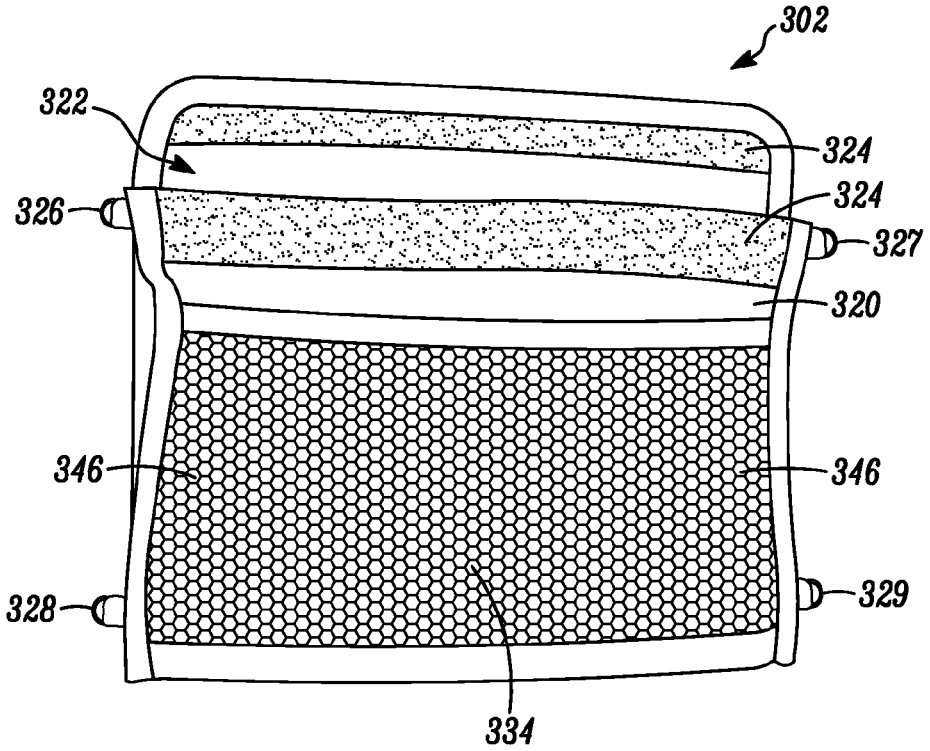
FIG. 18 shows a front view of the universal media pocket of FIG. 15 with the closing mechanism in the open position.
Figure 19:
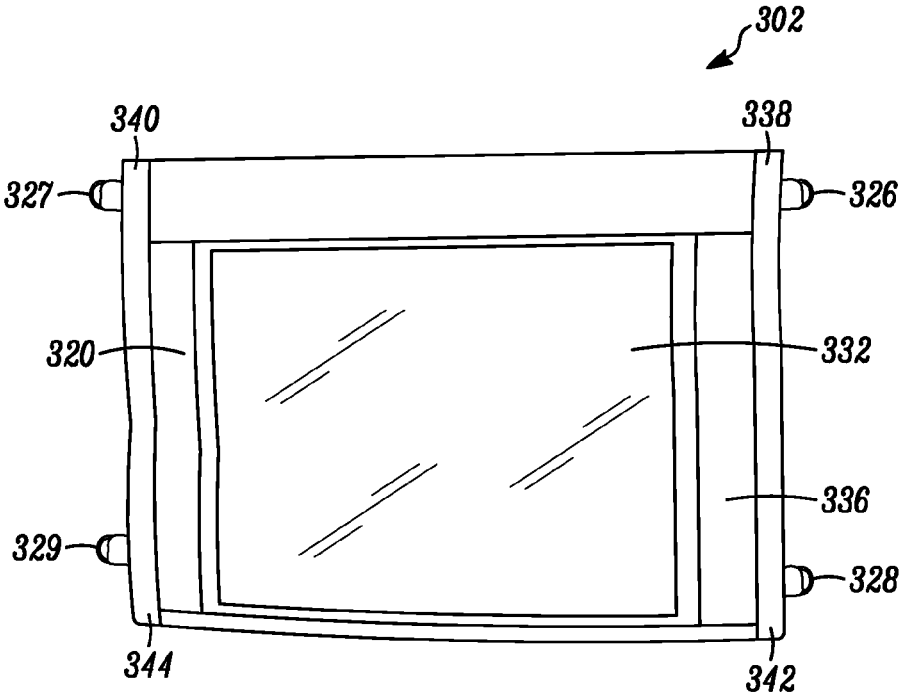
FIG. 19 shows a rear view of the universal media pocket of FIG. 15 with the closing mechanism in the closed position.
Figure 20:
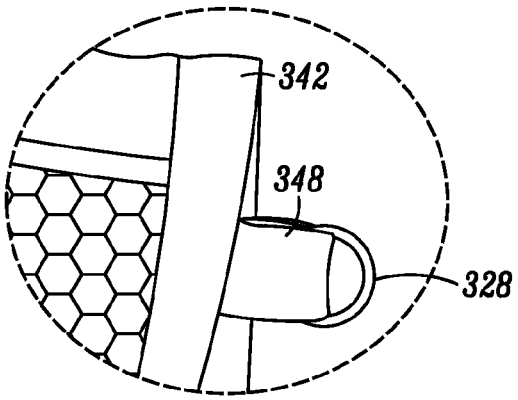
FIG. 20 shows a close-up view of a ring attached to a corner of the universal media pocket of FIG. 15.
Figure 21:
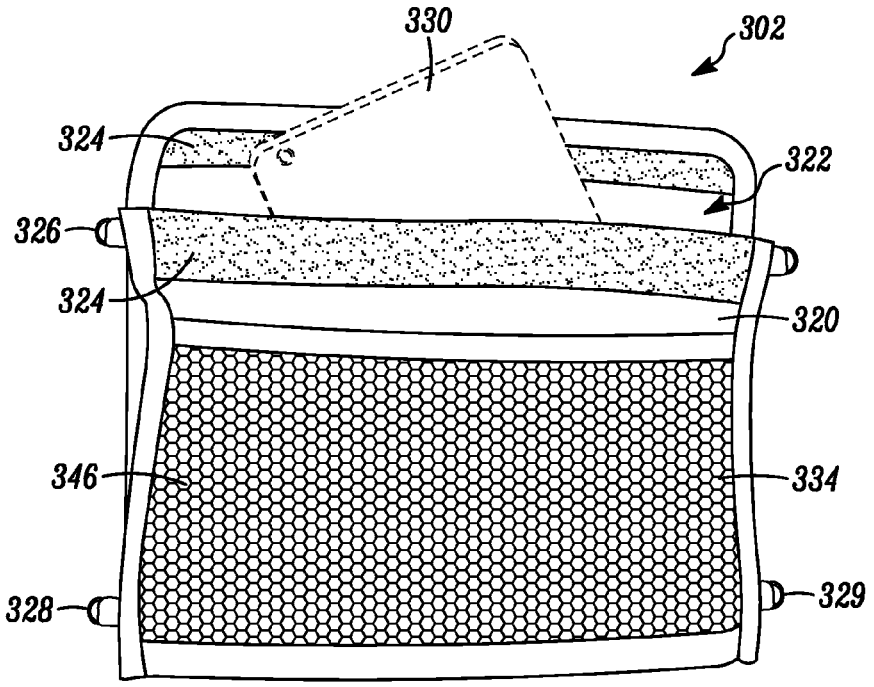
FIG. 21 shows a front view of the universal media pocket of FIG. 15 with an electronic device being inserted into the universal media pocket.
Figure 22:
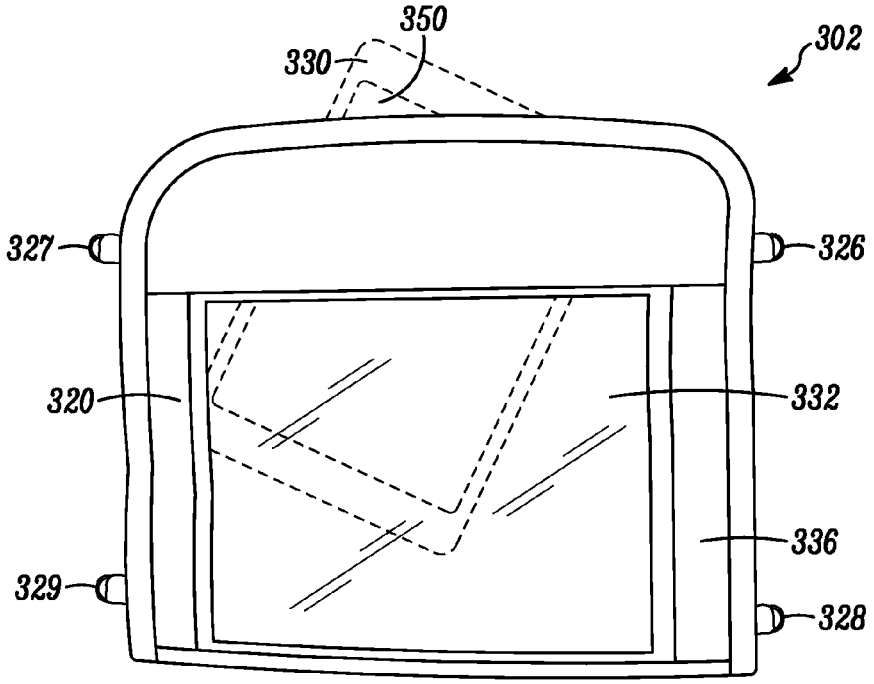
FIG. 22 shows a rear view of the universal media pocket of FIG. 15 with an electronic device being inserted into the universal media pocket.

FIG. 17 through FIG. 22 show additional details of universal media pocket 302 of FIG. 15 and FIG. 16. FIG. 17 shows a front view of universal media pocket 302 with a compartment 322 closed. FIG. 18 shows a front view of universal media pocket 302 with compartment 322 open. FIG. 19 shows a rear view of universal media pocket 302. FIG. 20 shows a close-up view of a ring 328 coupled to universal media pocket corner 342 of universal media pocket 302. FIG. 21 shows a front view of universal media pocket 302 with an electronic device 330 being slipped into compartment 322. FIG. 22 shows a rear view of universal media pocket 302 with an electronic device 330 being slipped into compartment 322.

Universal media pocket 302 includes an outer body pouch 320 that includes compartment 322 (FIG. 18 and FIG. 21) for encasing an electronic device. Outer body pouch 320 has a front side 334 and a rear side 336, and, in this embodiment, four corners, a first corner 338, a second corner 340, a third corner 342 and a fourth corner 344. In some embodiments, outer body pouch 320 has other shapes, sizes, and number of corners. Outer body pouch 320 also has four rings coupled to outer body pouch 320, a first ring 326, a second ring 327, a third ring 328, and a fourth ring 329. Rings 326, 327, 328, and 329 are used to couple universal media pocket 302 to chair 304, or other objects. FIG. 20 shows a close-up view of corner 342, and ring 328 coupled to corner 342 of universal media pocket 302 using tab 348. In the embodiment shown in FIG. 15 and FIG. 16, first ring 326 is removeably coupled to first hook 314, and second ring 327 is removeably coupled to second hook 316. Universal media pocket 302 hangs from arm 312 in response to first ring 326 being coupled to first hook 314, and second ring 327 being coupled to second hook 316. Rings 326, 327, 328, and 329 are used to couple universal media pocket 302 to other objects when universal media pocket 302 is removed from chair 304. For example, rings 326, 327, 328, and 329 can be used to couple universal media pocket 302 to a tent, a sleeping bag, a cot, a camper, or any other item or object. In the embodiment shown in the figures, rings 326, 327, 328, and 329 are each on separate corners 338, 349, 342 and 344 of universal media pocket 302, but this is not meant to be limiting. In some embodiments, rings 326, 327, 328, and 329 are coupled to other positions on universal media pocket 302. In some embodiments, there are more or less than four rings on universal media pocket 302.

Universal media pocket 302 also includes a closing mechanism 324 that shuts compartment 322, as shown in FIG. 18. FIG. 18 shows a front view of universal media pocket 302 with closing mechanism 324 in the opened position. In this embodiment, closing mechanism 324 is a pair of hook and look attachments which shut compartment 322 when they are coupled. It is to be understood that closing mechanism 324 can be any type of closing mechanism such as a zipper, one or more snaps, ties, buttons, etc.

Universal media pocket 302 also includes mesh pocket 334 as shown in FIG. 18. Mesh pocket 334 provides additional storage space in universal media pocket 302. Universal media pocket 302 also includes a transparent window 332 in a side of outer body pouch 320. FIG. 19 shows a rear view of universal media pocket 302, showing transparent window 332 in rear side 336 of outer body pouch 320. Transparent window 332 is useful for viewing a display on an electronic device stored in universal media pocket 302, as illustrated in FIG. 21 and FIG. 22. FIG. 21 shows a front view of universal media pocket 302, with an electronic device 330 being slid into compartment 322. FIG. 22 shows a rear view of universal media pocket 302 with electronic device 330 being slid into compartment 322. Electronic device 330 has a display 350, and, as can be seen in FIG. 22, display 350 is visible through transparent window 332 when electronic device 330 is encased in universal media pocket 302. Universal media pocket 302 is formed with water resistant seams, material, and closing mechanism 324, so that when electronic device 330 is encased in universal media pocket 302, electronic device 330 is protected from the elements and moisture, and yet display 350 can still be used. When camping or during other outdoor activities, electronic device can be viewed and controlled while encased in universal media pocket 302. Display 350 can be used to view videos, movies, read email, etc, while universal media pocket 302 is protected from the elements and coupled to chair 304 or another object. Hooks 326, 327, 328, and 329 can be used to coupled universal media pocket 302 with electronic device 330 to a tent wall, for example, for viewing videos or pictures on display 350. It is to be understood from this disclosure that universal media pocket 302 can hold many different items, protecting them from the elements in different environments, while keeping the items secure and safe.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A combination chair and universal media pocket, the chair comprising a seat portion, a backrest, at least one armrest, and a plurality of legs to support the chair on a support surface, the universal media pocket comprising:

a durable outer body;

a pair of handles, the pair of handles having a first handle and a second handle, the first handle and the second handle pivotably coupled to the durable outer body; and a closing mechanism at a base of the pair of handles and configured to close an inside volume enclosed by the durable outer body;

the pair of handles are adapted to be pivotable to a first position and attach the universal media pocket to the at least one armrest of the chair and wherein the pair of handles are adapted to be pivotable to a second position to allow removal of the universal media pocket from the object;

the first handle including a first set of at least one or more attachment devices and the second handle including a second set of at least one or more attachment devices, the first and second set of at least one or more attachment devices of the first and second handles are adapted to be coupled together;

the at least one armrest of the chair including a third set of at least one or more attachment devices;

the first handle and the second handle being pivotable to the first position so that the first set of at least one or more attachment devices of the first and second handles are adapted to couple to the third set of at least one or more attachment devices of the at least one armrest and secure the universal media pocket to the at least one armrest of the chair; and the first handle and the second handle being pivotable to the second position so that the first set of at least one or more attachment devices and the second set of at least one or more attachment devices of the first and second handles are adapted to couple to each other and secure the first and second handles to each other in the second position.

2. The combination chair and universal media pocket of claim 1, wherein the inside volume includes a compartment configured to accommodate a device.

3. The combination chair and universal media pocket of claim 1, wherein the first position is perpendicular to the second position.

4. The combination chair and universal media pocket of claim 3, wherein the pair of handles in the first position are perpendicular to the durable outer body.

5. The combination chair and universal media pocket of claim 4, wherein the pair of handles in the second position are parallel to the durable outer body.

6. The combination chair and universal media pocket of claim 3, wherein the inside volume includes at least two compartments to accommodate at least two electronic devices.

7. The combination chair and universal media pocket of claim 1, wherein the inside volume has a hard case lining configured to protect contents of the inside volume.

8. The combination chair and universal media pocket of claim 1, wherein each of the first and second set of at least one or more attachment devices of the first and second handles include a magnet such that in the first position, the magnet couples to a magnet of opposite polarity on the at least one armrest.

9. The combination chair and universal media pocket of claim 1, wherein each of the pair of handles is configured to be held in the second position by a hook and loop material in opposing faces of the pair of handles.

10. The combination chair and universal media pocket of claim 1, wherein the durable outer body includes at least one hook to removably couple the universal media pocket to the at least one armrest.

11. The combination chair and universal media pocket of claim 1, wherein the durable outer body includes at least one recess to accommodate a hook in the at least one armrest.

* * * * *